US008451142B2

(12) United States Patent
Groft et al.

(10) Patent No.: US 8,451,142 B2
(45) Date of Patent: May 28, 2013

(54) METERLESS REMOTE PARKING MONITORING SYSTEM

(76) Inventors: Eric Groft, Somerville, MA (US); Larry Berman, Delray Beach, FL (US)

( * ) Notice: Subject to any disclaimer, the term of this patent is extended or adjusted under 35 U.S.C. 154(b) by 108 days.

(21) Appl. No.: 12/805,079

(22) Filed: Jul. 12, 2010

(65) Prior Publication Data

US 2011/0063135 A1 Mar. 17, 2011

Related U.S. Application Data

(60) Provisional application No. 61/213,768, filed on Jul. 13, 2009.

(51) Int. Cl.
*G08G 1/01* (2006.01)

(52) U.S. Cl.
USPC ..... 340/933; 340/932.2; 340/937; 340/938; 340/904; 340/905; 340/539.1

(58) Field of Classification Search
USPC ..... 340/932.2, 933, 937, 938, 904, 942, 340/905, 955, 539.1; 701/1, 36, 13, 418; 235/381, 385
See application file for complete search history.

(56) References Cited

U.S. PATENT DOCUMENTS

| | | | | |
|---|---|---|---|---|
| 7,104,447 | B1 * | 9/2006 | Lopez et al. | 235/384 |
| 2005/0280555 | A1 * | 12/2005 | Warner | 340/932.2 |
| 2010/0017249 | A1 * | 1/2010 | Fincham et al. | 705/8 |

* cited by examiner

*Primary Examiner* — Daryl Pope
(74) *Attorney, Agent, or Firm* — Perman & Green, LLP

(57) ABSTRACT

A meter-less remote parking monitoring system, incorporating a plurality of vehicle detector and Radio Frequency Identification Reader (RFID) units deployed in individual parking spaces; a plurality of Cellular Gateway Radios, each Cellular Gateway Radio being connected to one of said plurality of vehicle detector and Radio Frequency Identification Units; a Command and Control Server; the plurality of Cellular Gateway Radios being connected to said Command and Control Server via the internet.

4 Claims, 4 Drawing Sheets

METERLESS REMOTE PARKING MONITORING SYSTEM

RELATED APPLICATIONS

This application is a non-provisional of and claims the benefit of U.S. Provisional Patent Application Ser. No. 61/213,768 filed on Jul. 13, 2009, the disclosure of which is incorporated by reference herein in its entirety.

BACKGROUND OF THE INVENTION

1. Field of the Invention

The invention relates to: (1) Using Radio Frequency Identification tags for Permitting in a parking lot to identify valid parkers from violators of permitted parking; (2) Employing space-by-space vehicle detection in addition to RFID equipped permits; (3) Employing a combined RFID permitting system with vehicle detection into a RAM system for Parking Management; and (4) Transmitting all proximate RFID tags read by any given RFID reader in the Meterless Remote Parking Monitoring system.

A version of this system uses this same technology for a paid parking environment. The processing is all the same as set forth herein for permitted spaces. The sole difference is that a motorist can be charged to park based on the identification number emitted by their RFID tag. This is linked to an account by a Command and Control Server to effect payment either using a credit card or a pre-paid account balance.

2. Related Art

The provisional patent application Ser. No. 61/202201 filed 5 Feb. 2009 which relates to multiple task specific processors such as an Application Processor, a Meter Controller and a Radio Processor all controlled via a shared SPI bus and using rechargeable batteries and solar power sources for controlling and monitoring a vehicle parking meter system.

The invention entitled: Parking System Employing RAM Techniques, Ser. No. 11/802,244, filed 21 May 2007 which relates to the management of vehicle parking systems and in particular to such systems using remote management techniques for enhancing management efficiency and to provide solutions to the parking system that could not otherwise be managed by (1) sensing, collecting recording and displaying data regarding all aspects of the environment pertaining to the parking system, (2) analyzing the data collected to create actionable outputs responsive to the needs of the public and the management of the parking system; (3) communicating with the various parking system components; and (4) receiving feedback to perform requested operations for the parking system.

SUMMARY OF THE INVENTION

The invention uses Radio Frequency Identification tags for permitting in a parking lot to identify valid parkers from violators of permitted parking. The invention uses space-by-space vehicle detection in addition to RFID equipped permits. The invention also uses a combined RFID permitting system with vehicle detection into a RAM system for Parking Management. The invention transmits all proximate RFID tags read by any given RFID reader in the Meterless Remote Parking Monitoring system.

A problem solved is that of enforcing parking that requires the motorist to possess a parking permit to park in a particular location that requires that each space be inspected to determine if each motorist parked in that location has the proper permit. Additionally, normal permits can be easily forged with modern printers and scanners.

This problem is overcome by equipping the permitted motorist with a physical permit tag containing a radio frequency identification tag (RFID) that allows a localized plurality of RFID readers to determine that there is a permitted vehicle present in its proximity. Significantly, RFID equipped permits would be very difficult to forge as they would not transmit the radio signal emitted by those issued by the issuing authority.

Even with the use of RFID equipped permits, there is no precise indicator of what spaces have been occupied by vehicles operated by non-permitted motorists.

This particular problem is overcome by using vehicle detectors in each space to allow precise monitoring as to which spaces have been occupied by a vehicle. Such devices can also cause the RFID readers to activate each time a new vehicle is detected. If the reader is able to locate a proximate RFID tag, it is known that the vehicle in said space is permitted. If no tag is able to be read, it is determined to be an unpermitted motorist and subject to penalty.

Local identification of violating motorists still requires on-site inspection of each location to enforce penalties for non-compliance with permitted parking.

This problem is solved by connecting an RFID system with vehicle detection to a Command and Control interface as described in the aforementioned RAM patent Ser. No. 11/802,244, enforcement personnel can be dispatched to the exact locations where enforcement is needed. This allows the parking areas to be enforced without regular patrolling saving fuel and personnel costs while increasing effectiveness of enforcement activities.

When so many RFID readers are placed so close to each other as they would be in a parking lot, readers are occasionally going to read the RFID tags from nearby spaces as opposed to the space it is intended to monitor.

By reading and transmitting the unique permit number of any tag within the reader's communication range, the reader is unlikely to falsely determine that no tag is present in the space it is monitoring. The command and control interface can maintain a record of each space and its status and the permit number associated with the vehicle currently parked there. If a reader mistakenly reads the tag from a nearby space, the command and control interface can disregard that Permit ID as the one associated with the car parked in that location. Among the various RFID permits' unique identification numbers, there may be multiple such misreads. If all readable numbers are sent to the command and control interface, the permit associated with the recently arriving vehicle can be determined by the process of elimination.

DETAILED DESCRIPTION

Figure 1:
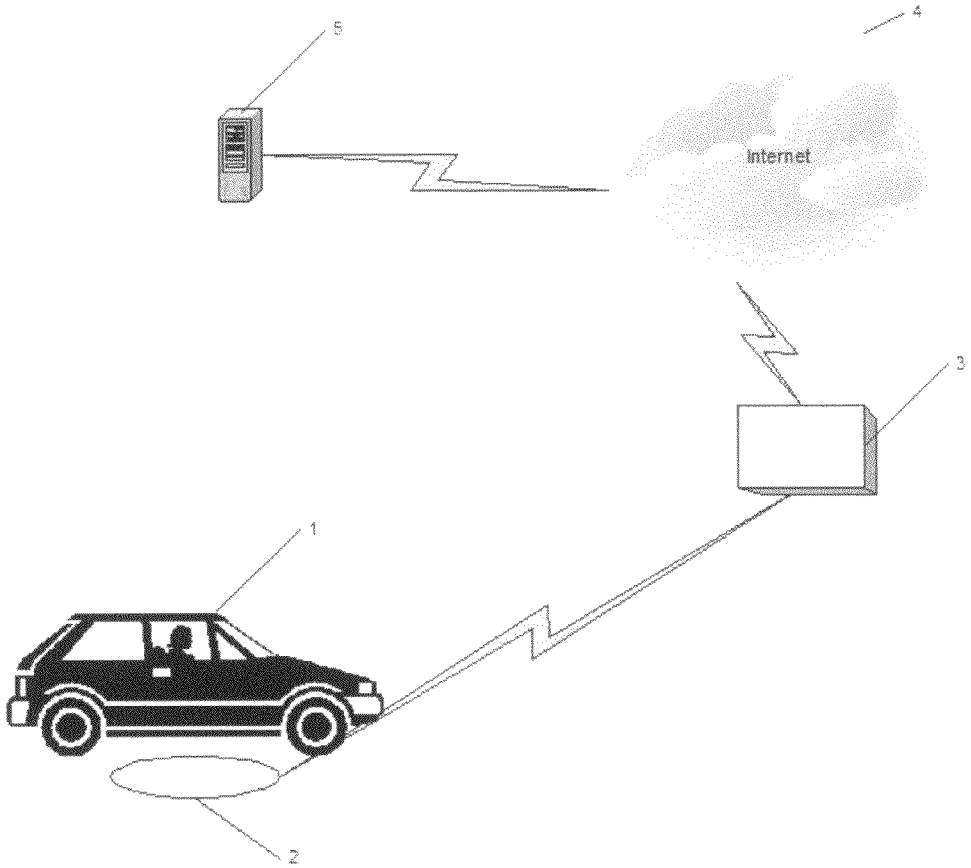
FIG. 1 illustrates the basic features of the Meter-less Remote Parking Monitoring System of the invention.

FIG. 1 illustrates the Command and Control Server (5) being connected to the Internet (4) and through the Internet to the Cellular Gateway Radio (3), which in turn is in wireless communication with the Vehicle Detector and RFID Reader Unit (2). The arrival of a new motorist (1) is detected by the Vehicle Detector and RFID Reader Unit (2). This prompts the RFID Reader (2) to activate and attempt to read the signal emitted by any RFID equipped permit inside the vehicle. The information regarding the new arrival and any RFID permits in a range of RFID permits are transmitted up the communications connections to the Command and Control Server 5.

Figure 2:
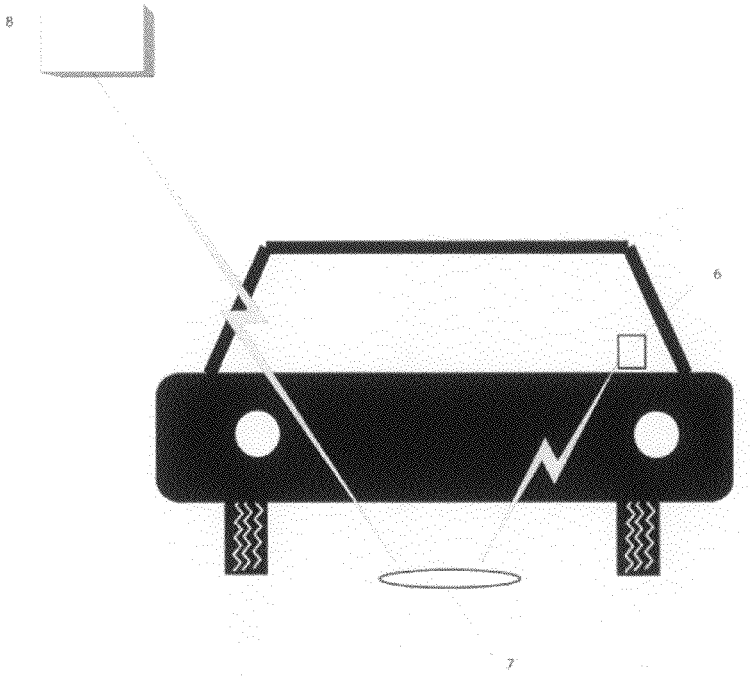
FIG. 2 illustrates the RFID Reader reading the RFID permit placed inside the vehicle in the space it is monitoring.

FIG. 2 illustrates the RFID Reader reading the RFID permit (6) located inside the vehicle in the space that is being monitored. Once this information is obtained by the RFID Reader (7), it is passed wirelessly to the Cellular Gateway radio (8) and subsequently on to the internet (4) (see FIG. 1) for transmission to the Command and Control Server (5) (FIG. 1). The arrival of a new motorist is detected by the Vehicle Detector and RFID Reader Unit 2. This prompts the RFID Reader Unit 2 to activate and attempt to read the signal emitted by any RFID—equipped permit. The information regarding the new arrival and any RFID permits in range are transmitted up the communications connections to the Command and Control Server 5.

Figure 3:
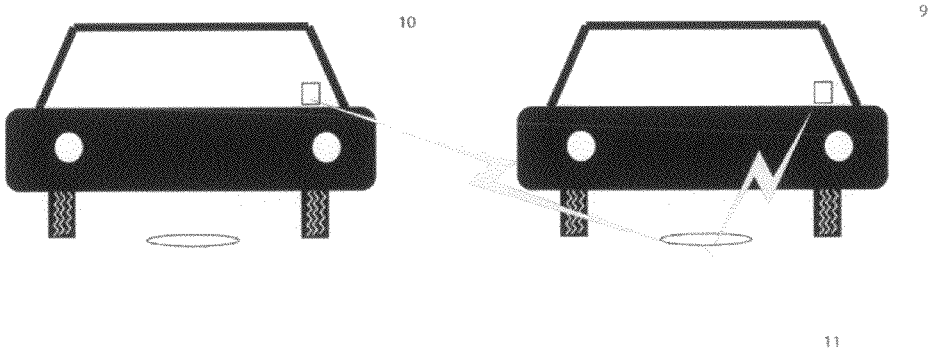
FIG. 3 illustrates the problem of crosstalk that may occur in parking systems of the type disclosed herein.

FIG. 3 illustrates the problem of crosstalk that may occur in parking systems of the type disclosed herein. The vehicle detector (11) triggers the RFID Reader (2) (FIG. 1) to read any proximate RFID permits (9), (10). In some cases, the signal from a permit in a nearby vehicle (10) to be read as well as the one(9) in the vehicle having just arrived at the parking space monitored by the vehicle detector (11) controlling the RFID Reader (2) (FIG. 1).

Figure 4:
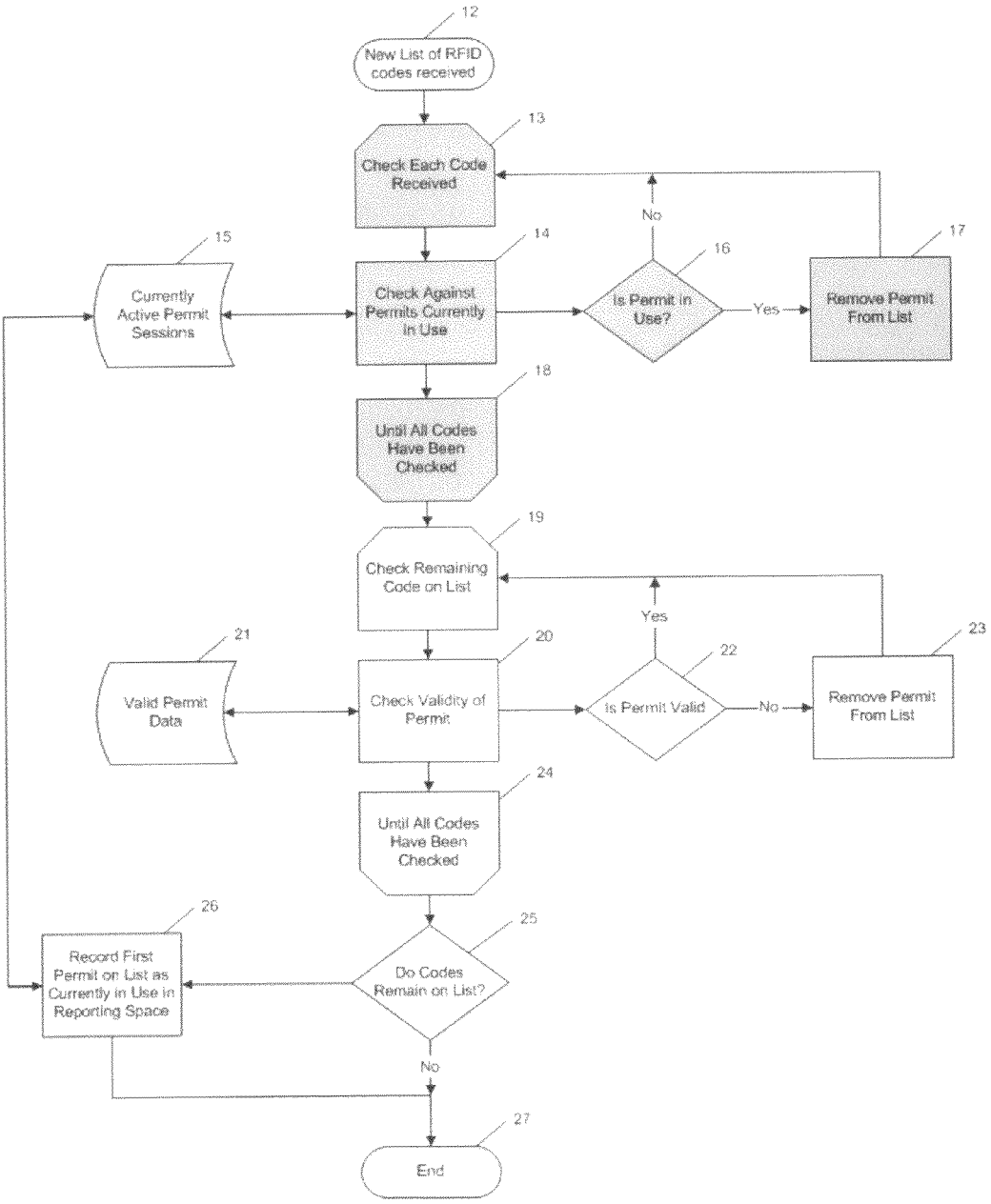
FIG. 4 shows the means by which multiple permits are eliminated.

FIG. 4 illustrates the method by which multiple permits are eliminated. First, the process loops through each code (13) and checking them individually (14) against a list of the currently recorded active permits sessions (15). If the permit is already recorded in use (16) it is removed from the list of codes to be checked (17). This loop continues until all codes have been checked (18). At this stage the remaining codes are fed into a loop to check the validity of the permit (19) in which each code is again checked (20) against a database of permit codes (21) to verify that the permit is active and authorized for use in the location. If the permit code is not valid (22), it is removed from the list of codes This process then continues until all codes on the list have been verified (24). If there are remaining codes on the list (25), the first recorded code is registered (26) in the database of active permits (15) and the process comes to an end (2). If no codes remain in step (25), the process immediately ends (27).

The invention claimed is:

1. A meter-less remote parking monitoring system, comprising:

a plurality of vehicle detector and Radio Frequency Identification Reader (RFID) units deployed in individual parking spaces and configured for communication with at least one vehicle identification unit;

a plurality of Cellular Gateway Radios, each Cellular Gateway Radio being connected to one of said plurality of vehicle detector and Radio Frequency Identification Units; and a Command and Control Server;

wherein said plurality of Cellular Gateway Radios being connected to said Command and Control Server via the internet and wherein the command and Control Server is configured to validate a parking space in which a vehicle identification unit is located when multiple vehicle identification units are in communication with a common Radio Frequency Identification Reader (RFID) unit.

2. A system as in claim 1, wherein each of the at least one vehicle identification unit is mounted to a a vehicle and includes a unique identification code representing authorization for a motorist to park in a given parking space and an associated RFID permit transmitter for transmitting the unique identification code; the vehicle detector for a given space detects the arrival of new vehicles at which time the RFID reader is triggered to read the unique identification code transmitted by the RFID permit placed in the vehicle driven by a motorist authorized to park in the parking space and upon the successful reading of this identification code, said Vehicle Detector and RFID Unit transmits the unique identification code via the wirelessly connected Cellular Gateway Radio to the Central Command and Control Server through the internet.

3. A process in a meter-less remote parking monitoring system performed by a Command and Control Server wherein a unique identification code from an RFID permit transmitted from a Vehicle Detector and RFID Reader Unit in a parking space is verified against a list of issued parking permits to verify that the parking permit:

a) uses an existing code, b) is permitted to be parked in the parking space in which the vehicle is parked, c) has not expired, and d) is in good standing with respect to payments for the permitted parking space, wherein the Command and Control Server validates in which parking space the RFID permit is located when multiple vehicle identification units are in communication with a common RFID Reader Unit.

4. A process in a meter-less remote parking monitoring system wherein a Vehicle Detector and RFID Reader Unit will read all RFID permits within its proximity and transmits all unique identification codes to a Central Command and Control Server Unit where all unique identification codes are compared to the unique identification codes transmitted from other Vehicle Detector and RFID Reader Units monitoring other parking spaces to identify the permit associated with the actual vehicle that just arrived in the parking space monitored by the Vehicle Detector and RFID Reader Unit.

* * * * *